US010073369B2

(12) United States Patent
Tomiie

(10) Patent No.: US 10,073,369 B2
(45) Date of Patent: Sep. 11, 2018

(54) IMAGE FORMING APPARATUS

(71) Applicant: KYOCERA Document Solutions Inc., Osaka (JP)

(72) Inventor: Norio Tomiie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/855,376

(22) Filed: Dec. 27, 2017

(65) Prior Publication Data

US 2018/0196369 A1 Jul. 12, 2018

(30) Foreign Application Priority Data

Jan. 6, 2017 (JP) ..... 2017-001199

(51) Int. Cl.
*G03G 15/02* (2006.01)

(52) U.S. Cl.
CPC ..... *G03G 15/0266* (2013.01)

(58) Field of Classification Search
CPC ..... G03G 15/1675; G03G 15/1665; G03G 15/065; G03G 15/0266
See application file for complete search history.

(56) References Cited

U.S. PATENT DOCUMENTS 4,851,960 A 7/1989 Nakamura et al. ..... 361/225
2004/0202487 A1* 10/2004 Sakai ..... G03G 15/0266 399/50
2013/0136468 A1* 5/2013 Shimizu ..... G03G 15/0189 399/44
2014/0314435 A1* 10/2014 Kato ..... G03G 15/1675 399/66

FOREIGN PATENT DOCUMENTS

JP 63-149668 A 6/1988
JP 2007-199094 A 8/2007

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

An image forming apparatus includes a high-voltage generating circuit which applies to a charging member an oscillation voltage in which a DC voltage and an AC voltage are superimposed, a voltage controller which controls the DC voltage and a peak-to-peak voltage value Vpp of the AC voltage, and a current detector which detects a DC current value Idc between the charging member and an image carrier. The voltage controller detects an Idc(O') when an oscillation voltage having a Vpp(O') at an intersection point of a straight line L1 passing through coordinates A(Vpp(A), Idc(A)) and coordinates B(Vpp(B), Idc(B)) and a straight line passing through coordinates C(Vpp(C), Idc(C)) and parallel to a coordinate axis representing Vpp. Vpp(O) at an intersection point O of a straight line L2 passing through coordinates C and coordinates O'(Vpp(O'), Idc(O')) and the straight line L1 is determined as an appropriate peak-to-peak voltage value.

7 Claims, 5 Drawing Sheets

--Related Art--

--Related Art--

IMAGE FORMING APPARATUS

INCORPORATION BY REFERENCE

This application is based upon and claims the benefit of priority from the corresponding Japanese Patent Application No. 2017-001199 filed on Jan. 6, 2017, the entire contents of which are incorporated herein by reference.

BACKGROUND

The present disclosure relates to an image forming apparatus including a charging member which charges an image carrier, and in particular relates to a method for appropriately controlling a peak-to-peak voltage value of an alternating-current voltage applied to the charging member.

In conventional image forming apparatuses using an electro-photographic process, such as laser printers and digital multifunction peripherals, the following process is typically performed. A surface of a photosensitive drum (an image carrier) having photoconductivity is uniformly charged by a charging device, then the surface of the photosensitive drum is exposed to light from an exposure device to form an electrostatic latent image on the photosensitive drum, and then the thus formed electrostatic latent image is developed into a toner image by a developing device. Next, after this toner image is transferred onto a surface of a recording medium such as a sheet by a transfer section, the toner image is fixed by a fixing section onto the surface of the recording medium, and this completes a process of a series of image formation. After the transfer of the toner image, residual toner remaining on the surface of the photosensitive drum is removed by a cleaning section, and further, residual charge remaining on the surface of the photosensitive drum is removed as necessary by using a charge removing lamp, whereby the photosensitive drum is made ready for the next image formation.

In recent years, instead of corotron-type and scorotron-type charging devices, a contact charging type charging device with little generation of ozone is used, in which the charging member (a charging roller or the like) is disposed in contact with, or close to, the photosensitive drum to charge the photosensitive drum. Among this type of charging members, there is one to which is applied an oscillation voltage, in which a direct-current (DC) voltage and an alternating-current (AC) voltage are superimposed, to charge the photosensitive drum.

For example, it is known that, when a peak-to-peak voltage Vpp of the AC voltage in the oscillation voltage is raised, a charging voltage of the photosensitive drum rises in proportion to the rise of the peak-to-voltage Vpp, and a charging potential is saturated when the peak-to-peak voltage Vpp reaches a level approximately twice the level of a charging start voltage of the DC voltage, such that the charging potential does not vary much even if the peak-to-peak voltage Vpp is further raised. It is also known that, for securely uniform charging, it is necessary for the peak-to-peak voltage Vpp of the applied oscillation voltage to be equal to, or higher than, twice the charging start voltage in applying the DC voltage determined by various characteristics of the image carrier, and that the charging voltage obtained at that time depends on a DC component of the applied voltage.

There is also known one capable of setting a highly accurate appropriate peak-to-peak voltage Vpp of an AC voltage regardless of change in ambient conditions such as temperature and humidity or regardless of aging of the photosensitive drum, the charging member, and the like. Specifically, for the purpose of obtaining an appropriate peak-to-peak voltage value, an appropriate charging start voltage is calculated from two peak-to-peak voltages lower than twice a charging start voltage and one peak-to-peak voltage equal to, or higher than, twice the charging start voltage, and the calculated appropriate charging start voltage is maintained constant as the peak-to-peak voltage of an AC voltage applied to a charging member in forming an image.

SUMMARY

According to an aspect of the present disclosure, an image forming apparatus includes an image carrier, a charging member, a high-voltage generating circuit, a voltage controller, and a current detector. The image carrier has a surface on which an electrostatic latent image is to be formed. The charging member charges the surface of the image carrier. The high-voltage generating circuit applies to the charging member an oscillation voltage in which a DC voltage and an AC voltage are superimposed. The voltage controller controls the DC voltage and a peak-to-peak voltage value Vpp of the AC voltage. The current detector detects a DC current value Idc between the charging member and the image carrier. The high-voltage generating circuit applies to the charging member, as the oscillation voltage, an oscillation voltage having a peak-to-peak voltage value Vpp(A), an oscillation voltage having a peak-to-peak voltage value Vpp(B), and an oscillation voltage having a peak-to-peak voltage value Vpp(C), the peak-to-peak voltage value Vpp(A) and the peak-to-peak voltage value Vpp (B) being set to values assumed to be lower than a voltage value at an inflection point at which inclination of the oscillation voltage changes in a characteristic curve on a two-dimensional coordinate system indicating a relationship between the peak-to-peak voltage value Vpp and the DC current value Idc when the peak-to-peak voltage value Vpp is raised, the peak-to-peak voltage value Vpp(C) being set to a value assumed to be higher than the voltage value at the inflection point. The current detector detects DC current values Idc(A), Idc(B), and Idc(C) which respectively appear between the charging member and the image carrier when the oscillation voltage having the peak-to-peak voltage value Vpp(A), the oscillation voltage having the peak-to-peak voltage value Vpp(B), and the oscillation voltage having the peak-to-peak voltage value Vpp(C) are applied to the charging member. The voltage controller calculates a straight line LI passing through coordinates A(Vpp(A), Idc(A)) and coordinates B(Vpp(B), Idc(B)) on the two-dimensional coordinate system. Further, the voltage controller, by using the peak-to-peak voltage value Vpp at an intersection point of a straight line passing through coordinates C(Vpp(C), Idc(C)) and parallel to the coordinate axis representing the peak-to-peak voltage value Vpp and the straight line L1 as a provisional appropriate peak-to-peak voltage value Vpp (O'), detects a DC current value Idc(O') which appears when an oscillation voltage having the provisional appropriate peak-to-peak voltage value Vpp(O') is applied to the charging member Then, the voltage controller determines a peak-to-peak voltage value Vpp(O) at the intersection point O between a straight line L2 passing through the coordinates C(Vpp(C), Idc(C)) and coordinates O'(Vpp(O'), Idc(O)) and the straight line L1 as an appropriate peak-to-peak voltage value.

Further features and specific advantages of the present disclosure will become apparent from the following descriptions of preferred embodiments.

DETAILED DESCRIPTION

Figure 1:
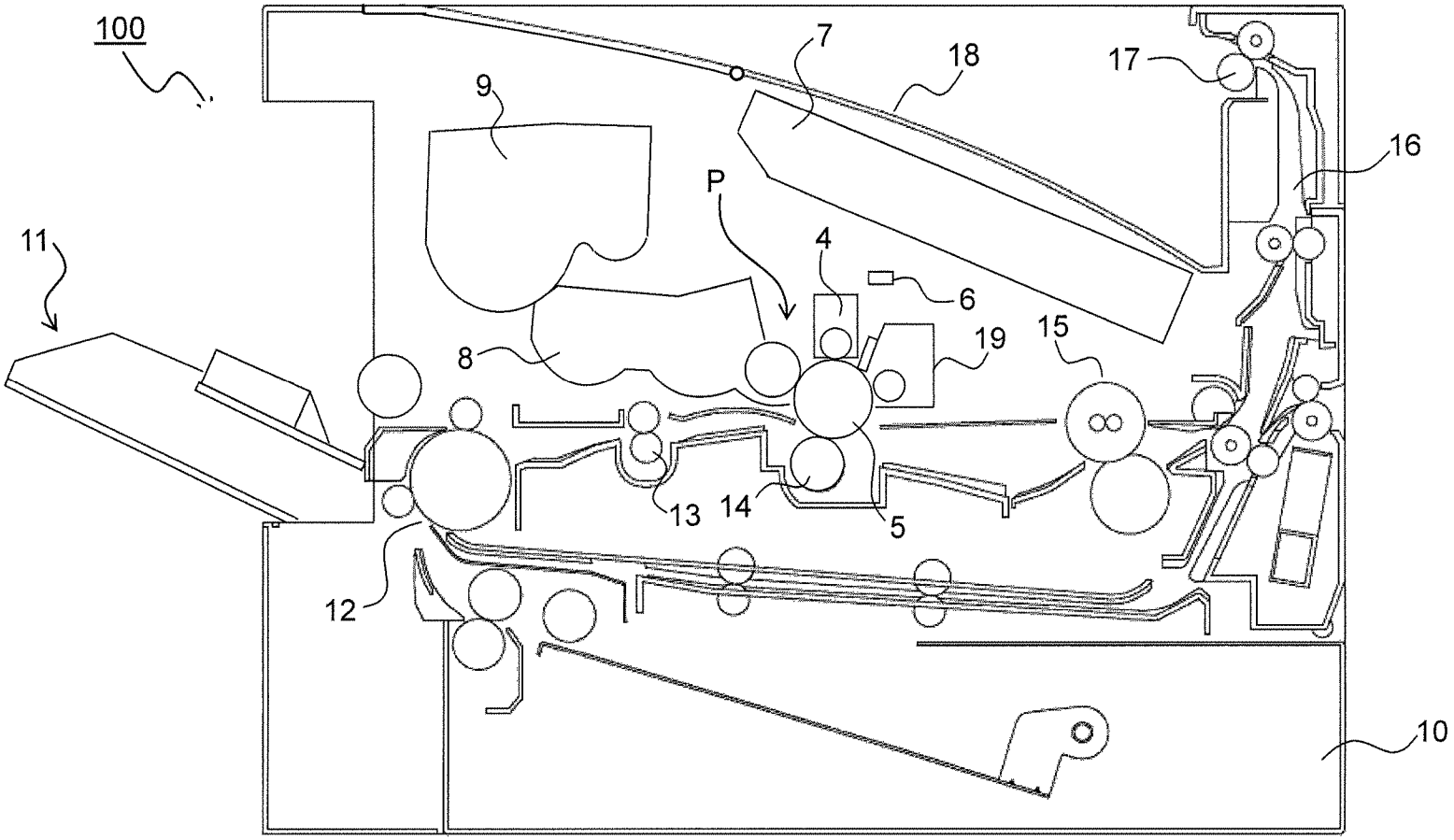
FIG. 1 is a side sectional view illustrating an inner structure of an image forming apparatus according to an embodiment of the present disclosure.

Hereinafter, embodiments of the present disclosure will be described with reference to the accompanying drawings. FIG. 1 is a side sectional view illustrating an inner structure of an image forming apparatus 100 according to an embodiment of the present disclosure. In the image forming apparatus (here, a monochrome printer) 100, there is arranged an image forming section P, which forms a monochrome image through charging, exposure, developing, and transfer steps. In the image forming section P, along a rotation direction of a photosensitive drum 5 (that is, in a counterclockwise direction in FIG. 1), there are arranged a charging device 4, an exposure unit (a laser scanning unit or the like) 7, a developing device 8, a transfer roller 14, a cleaning device 19, and a charge eliminating device 6.

The photosensitive drum 5 includes, for example, a drum base tube made of aluminum and a layer of amorphous silicon, which is a positive charging type photoconductor, formed as a photosensitive layer on a surface of the drum base tube by vapor deposition, and has a diameter of approximately 30 mm. The photosensitive drum 5 is configured to be driven by a drum driving section (not shown) to rotate at a constant speed about a support shaft.

In a case where an image forming operation is performed, the photosensitive drum 5 rotating in the counterclockwise direction is uniformly charged by the charging device 4, an electrostatic latent image is formed on the photosensitive drum 5 by a laser beam emitted from the exposure unit 7 based on document image data, and the developing device 8 makes a developer (hereinafter referred to as toner) adhere to the electrostatic latent image to form a toner image.

Toner is supplied to the developing device 8 from a toner container 9. Here, the image data is transmitted from a host device such as a personal computer (not shown). The charge eliminating device 6, which removes residual electric charge remaining on the surface of the photosensitive drum 5, is provided on a downstream side of the cleaning device 19 with respect to a rotation direction of the photosensitive drum 5.

A sheet (recording medium) is conveyed to the photosensitive drum 5, on which the toner image has been formed as described above, from a sheet feeding cassette 10 or a manual sheet feeding device 11 via a sheet conveyance path 12 and a registration roller pair 13, and the toner image formed on the surface of the photosensitive drum 5 is transferred by the transfer roller 14 onto the sheet. Residual toner remaining on the surface of the photosensitive drum 5 is removed by the cleaning device 19. The sheet, onto which the toner image has been transferred, is separated from the photosensitive drum 5 and conveyed to a fixing device 15, where the toner image is fixed on the sheet. After passing through the fixing device 15, the sheet is conveyed via a sheet conveyance path 16 to an upper part of the image forming apparatus 100, and is then discharged by a discharge roller pair 17 onto a discharge tray 18.

Figure 2:
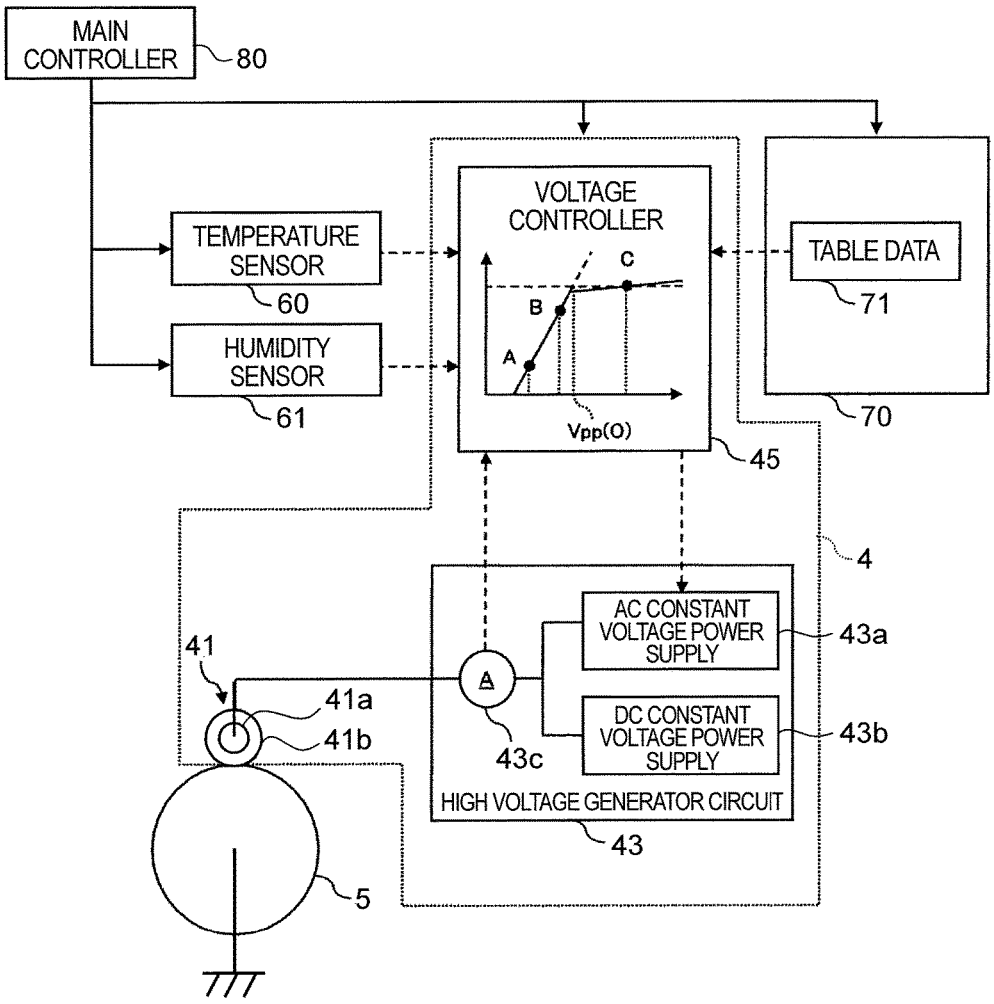
FIG. 2 is a block diagram illustrating a control route of the image forming apparatus according to the present embodiment.

FIG. 2 is a block diagram illustrating a control route of the charging device 4. First, a description will be given of the structure of the charging device 4. The charging device 4 includes a charging roller 41 which is disposed in contact with the photosensitive drum 5 and performs processing of charging the photosensitive drum 5, a high-voltage generating circuit 43 which generates an oscillation voltage, in which a DC voltage and an AC voltage are superimposed, to be applied to the charging roller 41, and a voltage controller 45 which controls the DC voltage and a peak-to-peak voltage value (Vpp) of the AC voltage.

The charging roller 41 is constituted of a metal core 41*a* and a conductive layer 41*b* made of a material such as epichlorohydrin rubber, which is conductive and elastic, the conductive layer 41*b* covering the metal core 41*a*. The charging roller 41 is disposed to be rotatable with a surface of the conductive layer 41*b* kept in contact with the surface of the photosensitive drum 5. The charging roller 41 is connected to the high-voltage generating circuit 43, and is charged when an oscillation voltage is applied thereto from the high-voltage generating circuit 43.

The high-voltage generating circuit 43 includes an AC constant voltage power supply 43*a* which outputs an AC voltage, a DC constant voltage power supply 43*b* which outputs a DC voltage, and a current detector 43*c* which detects a DC current value Idc between the charging roller 41 and the photosensitive drum 5. The high-voltage generating circuit 43, by superimposing the AC voltage outputted from the AC constant voltage power supply 43*a* and the DC voltage outputted from the DC constant voltage power supply 43*b*, generates an oscillation voltage, and applies the oscillation voltage to the charging roller 41. The AC constant voltage power supply 43*a* outputs an AC voltage having a peak-to-peak voltage value Vpp controlled by the voltage controller 45, which will be described later, and the DC constant voltage power supply 43*b* outputs a constant DC voltage.

Next, a control system of the image forming apparatus 100 will be described with reference to FIG. 2. The image forming apparatus 100 includes a main controller 80 constituted of a CPU, etc. The main controller 80 is connected to a storage 70 constituted of a ROM, a RAM, etc. The main controller 80 controls individual devices of the image forming apparatus 100 (the charging device 4, the exposure unit 7, the developing device 8, the transfer roller 14, the cleaning device 19, the fixing device 15, and the like) based on a control program and control data stored in the storage 70.

For example, the main controller 80 is connected to the voltage controller 45, a temperature sensor 60, and a humidity sensor 61. Note that the voltage controller 45 may be constituted of a control program stored in the storage 70. The temperature sensor 60 and the humidity sensor 61 respectively detect temperature and humidity in the image forming apparatus 100.

Figure 4:
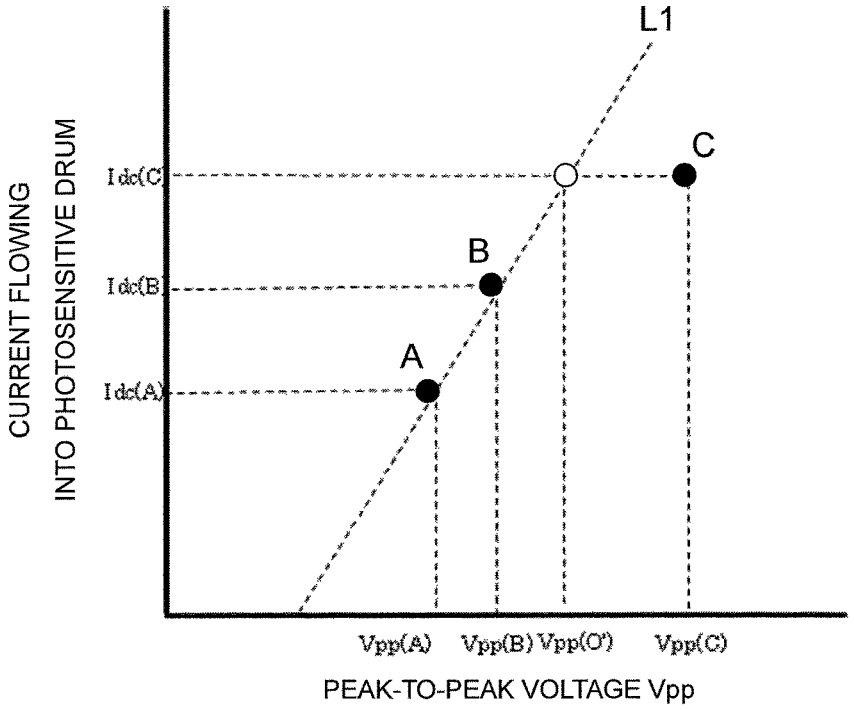
FIG. 4 is a graph in which an intersection point of a straight line L1 passing through two points (coordinates A and B) on a side of voltages lower than a shoulder voltage and a straight line passing through one point (coordinates C) on a side of voltages higher than the shoulder voltage and parallel to a coordinate axis (X-axis) representing the peak-to-peak voltage value Vpp is obtained, and also a peak-to-peak voltage value Vpp corresponding to the intersection point is calculated as a provisional appropriate peak-to-peak voltage value Vpp(O')

The storage 70 has a peak-to-peak voltage value table (table data) 71 in which a plurality of different peak-to-peak voltage values Vpp are stored in advance as the peak-to-peak voltage value Vpp used to control the oscillation voltage applied to the charging roller 41. For example, the peak-to-peak voltage value table 71 stores peak-to-peak voltage values Vpp(A), Vpp(B), and Vpp(C) as illustrated in FIG. 4, which will be described later.

The peak-to-peak voltage values Vpp(A) and Vpp(B) are set to values assumed to be lower than a voltage value (shoulder voltage) at an inflection point at which inclination of the charging voltage changes on an assumed characteristic curve in a two-dimensional coordinate system showing a relationship between a plurality of peak-to-peak voltage values Vpp and DC current values Idc corresponding to the plurality of peak-to-peak voltage values Vpp, while the peak-to-peak voltage value Vpp(C) is set to a value assumed to be higher than the voltage value at the inflection point. It is preferable for the peak-to-peak voltage value table 71 to store a plurality of sets of peak-to-peak voltage values Vpp(A), Vpp(B), and Vpp(C) respectively corresponding to various combinations of temperature and humidity in the image forming apparatus 100.

The voltage controller 45 controls the high-voltage generating circuit 43 which applies an oscillation voltage to the charging roller 41. Specifically, the voltage controller 45 so controls the AC constant voltage power supply 43*a* of the high-voltage generating circuit 43 as to generate an AC voltage having an appropriate peak-to-peak voltage value Vpp.

Figure 3:
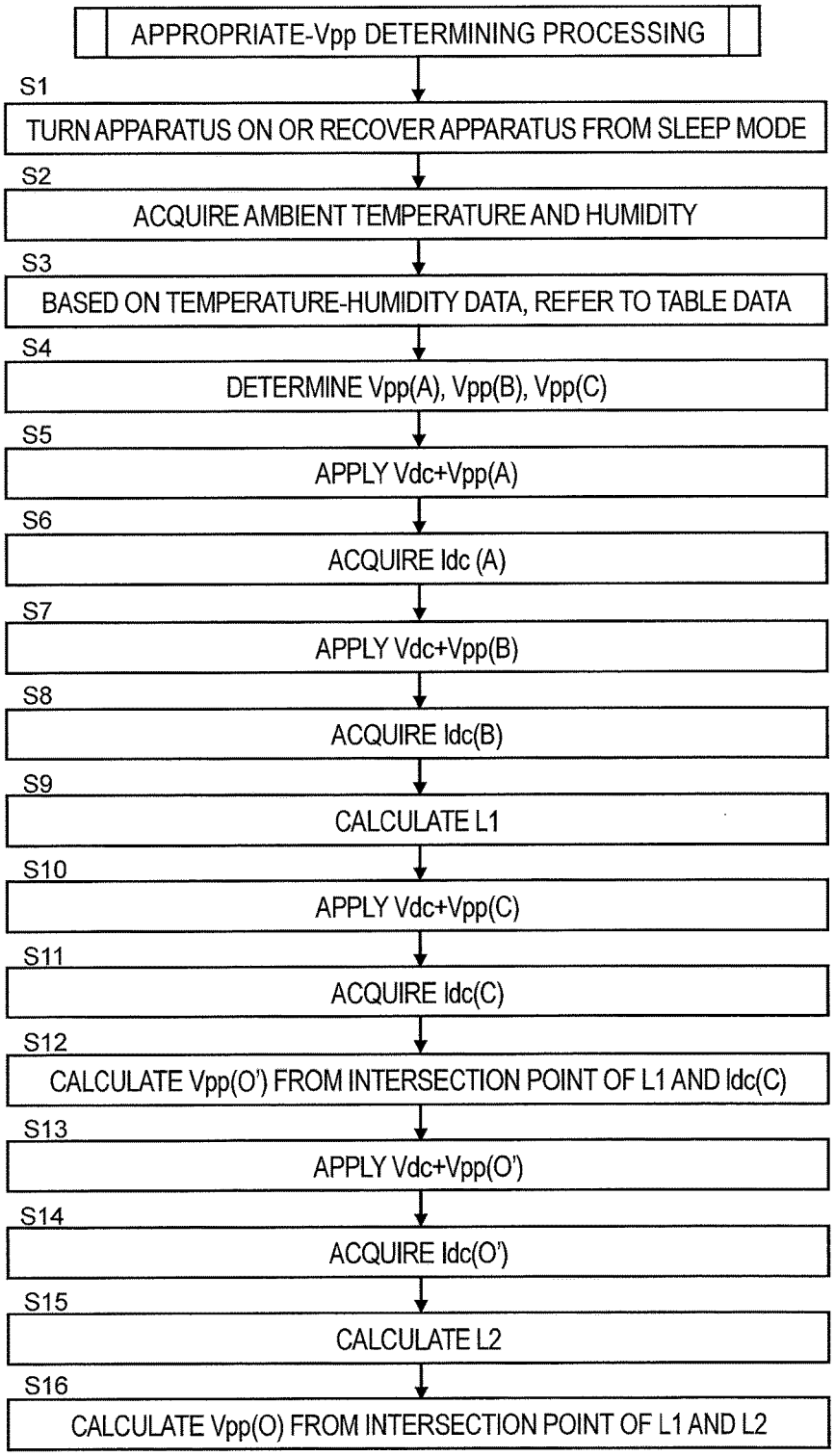
FIG. 3 is a flowchart illustrating an example of appropriate peak-to-peak voltage determining control executed in an image forming apparatus of the present disclosure.

FIG. 3 is a flowchart illustrating an example of control performed on determining the appropriate peak-to-peak voltage value Vpp to be applied to the charging roller 41 in the image forming apparatus 100 of the present disclosure. Referring to FIGS. 1 and 2, and later-described FIGS. 4 and 5 as necessary, and along with the steps shown in FIG. 3, a description will be given of a procedure of determining the appropriate peak-to-peak voltage value Vpp. Note that a test apparatus (TASKalfa7551ci, a product of KYOCERA Document Solutions Inc.) was operated at a system speed of 393 mm/sec, and an a-Si photosensitive drum having a diameter of 40 mm was used as the photosensitive drum 5. The photosensitive drum 5 was charged by means of a contact charging method using the charging roller 41.

When the image forming apparatus 100 is turned on, or when recovery from a sleep (power saving) mode is executed (Step S1), the main controller 80 acquires a temperature and a humidity (an ambient temperature and an ambient humidity) in the image forming apparatus 100 detected by a temperature sensor 60 and a humidity sensor 61 (Step S2). Then, the voltage controller 45, based on the combination of the temperature in the image forming apparatus 100 detected by the temperature sensor 60 and the humidity in the image forming apparatus 100 detected by the humidity sensor 61, refers to the peak-to-peak voltage value table 71 (Step S3), and determines the peak-to-peak voltage values Vpp(A), Vpp(B), and Vpp(C) appropriate to the ambient temperature and the ambient humidity (Step S4).

Next, the high-voltage generating circuit 43 applies to the charging roller 41 an oscillation voltage for charging the photosensitive drum 5 to a predetermined surface potential, in which a DC voltage Vdc and an AC voltage having the peak-to-peak voltage value Vpp(A) are superimposed (Step S5). The voltage controller 45 acquires a DC current value Idc(A) corresponding to the peak-to-peak voltage value Vpp (A) from the current detector 43*c* (Step S6).

Likewise, the high-voltage generating circuit 43 applies to the charging roller 41 an oscillation voltage for charging the photosensitive drum 5 to the predetermined surface potential, in which the DC voltage Vdc and an AC voltage having the peak-to-peak voltage value Vpp(B) are superimposed (Step S7). The voltage controller 45 acquires a DC current value Idc(B) corresponding to the peak-to-peak voltage value Vpp(B) from the current detector 43*c* (Step S8).

Then, as shown in FIG. 4, the voltage controller 45 calculates, with respect to an assumed characteristic curve on a two-dimensional coordinate system showing a relationship between a plurality of peak-to-peak voltage values Vpp and a plurality of AC current values Idc respectively corresponding to them, a straight line L1 which passes through coordinates A (Vpp(A), Idc(A)) and coordinates B(Vpp(B), Idc(B)) and indicates characteristics of voltages lower than a voltage value at an inflection point (Step S9).

Next, the high-voltage generating circuit 43 applies to the charging roller 41 an oscillation voltage in which the DC voltage Vdc and an AC voltage having the peak-to-peak voltage value Vpp(C) are superimposed (Step S10). The voltage controller 45 acquires a DC current value Idc(C) corresponding to the peak-to-peak voltage value Vpp (C) from the current detector 43*c* (Step S11).

Then, the voltage controller 45 obtains an intersection point (indicated by a white circle ○ in FIG. 4) of a straight line passing through coordinates C(Vpp(C), Idc(C)) and parallel to a coordinate axis (x-axis) representing the peak-to-peak voltage value Vpp and the straight line L1, and calculates a peak-to-peak voltage value Vpp corresponding to the intersection point as a provisional appropriate peak-to-peak voltage value Vpp(O') (Step S12).

Next, the high-voltage generating circuit 43 applies an oscillation voltage in which the DC voltage Vdc and an AC voltage having the provisional appropriate peak-to-peak voltage value Vpp(O') are superimposed to the charging roller 41 (Step S13). The voltage controller 45 acquires a DC current value Idc(O') corresponding to the peak-to-peak voltage value Vpp(O') from the current detector 43*c* (Step S14).

Figure 5:
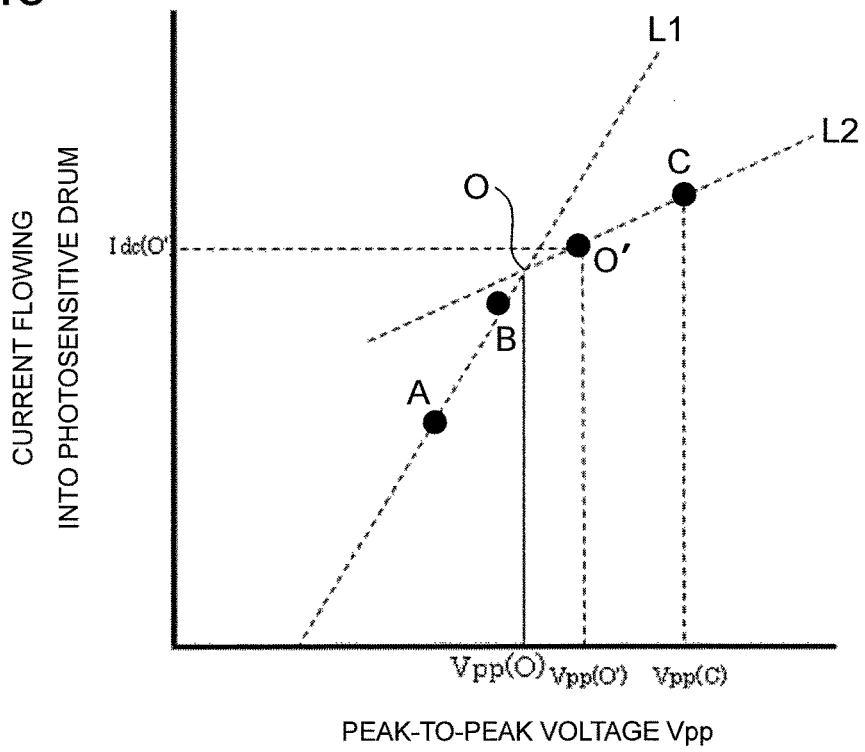
FIG. 5 is a graph in which a straight line L2 passing through coordinates C and coordinates O' is calculated, coordinates of an intersection point of the straight lines L1 and L2 are calculated as inflection point O, and also an appropriate peak-to-peak voltage value Vpp(O) corresponding to the infection point O is calculated.
Figure 6:
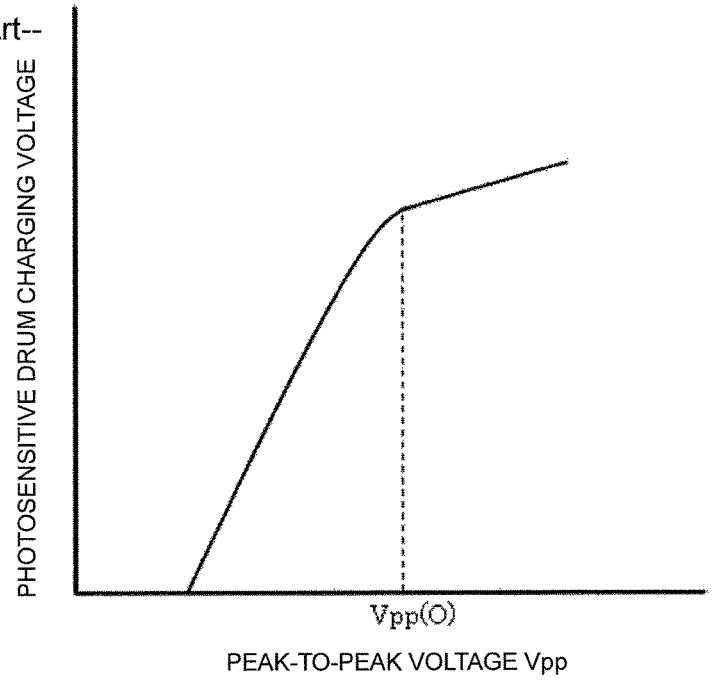
FIG. 6 is a graph illustrating a relationship between a peak-to-peak voltage applied to a charging roller and a charging voltage of a photosensitive drum in a conventional image forming apparatus.
Figure 7:
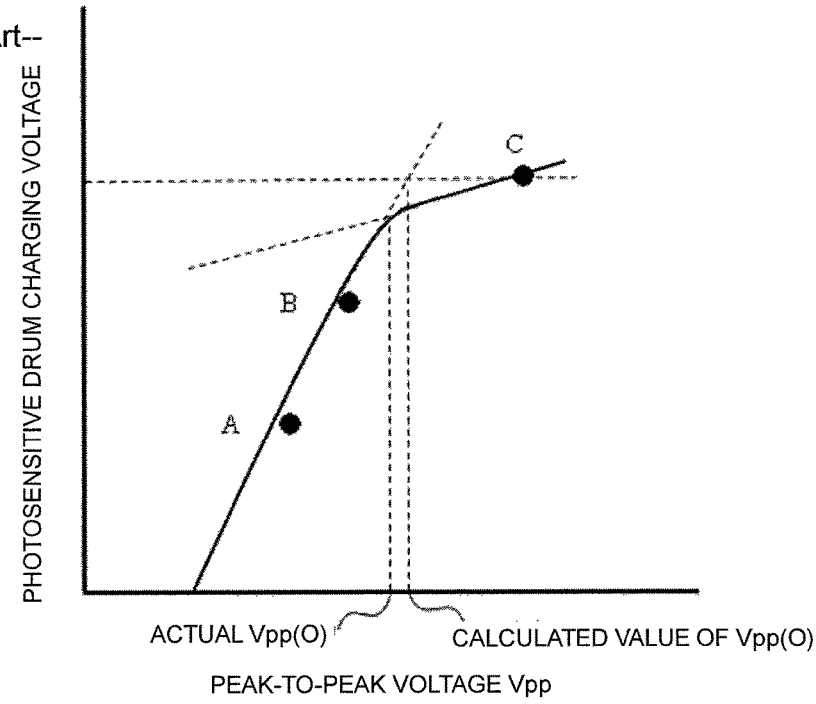
FIG. 7 is a graph illustrating difference between actual Vpp(O) and Vpp(O) obtained by calculation from two points (coordinates A and B) on the side of voltages lower than the shoulder voltage and one point on the side of voltages higher than the shoulder voltage in the conventional image forming apparatus.

Further, as shown in FIG. 5, the voltage controller 45 calculates a straight line L2 passing through coordinates C(Vpp(C), Idc(C)) and coordinates O'(Vpp(O'), Idc(O)) (Step S15). Then, the voltage controller 45 detects coordinates of an intersection point of the straight lines L1 and L2 as an inflection point O, and also calculates an appropriate peak-to-peak voltage value Vpp(O) corresponding to the infection point O (Step S16).

According to the above procedure, the calculated appropriate peak-to-peak voltage value Vpp(O) is a value extremely close to the voltage (the shoulder voltage) at the infection point on the assumed characteristic curve showing Vpp-Idc characteristics. Thereby, it is possible to effectively reduce occurrence of increased surface friction coefficient of the photosensitive drum 5 and occurrence of image deletion under a high-temperature, high-humidity environment, which result from an excessive amount of discharge from the charging roller 41.

Further, volume resistance of the charging roller 41 varies with the temperature and the humidity in the image forming apparatus 100, and thus the assumed characteristic curve indicating Vpp-Idc characteristics also varies accordingly. Thus, in a case where the peak-to-peak voltage values Vpp(A), Vpp(B), and Vpp(C) used to calculate the appropriate peak-to-peak voltage value Vpp (O) are each set to a constant value regardless of the temperature and the humidity, there is a risk that Vpp(C), for example, will be set to a value lower than the value at the infection point on the assumed characteristic curve.

To prevent such a risk, in the present embodiment, Vpp (A), Vpp(B), and Vpp(C) are determined by referring to the peak-to-peak voltage value table 71 based on the temperature and the humidity in the image forming apparatus 100. Thereby, it is possible to set Vpp(A), Vpp(B), and Vpp(C) to appropriate values corresponding to temperature-humidity conditions in the image forming apparatus 100, and thus to calculate the appropriate peak-to-peak voltage value Vpp(O) with high accuracy.

Here, in the peak-to-peak voltage value table 71 in the present embodiment, the peak-to-peak values Vpp(A), Vpp (B), and Vpp(C) corresponding to the temperature and the humidity in the image forming apparatus 100 are set in advance, but this is not meant as a limitation. For example, a peak-to-peak voltage value table 71 based on either one of the temperature and the humidity may be used instead.

Further, the volume resistance of the charging roller 41 varies with an accumulated use time of the charging roller 41, and accordingly, the peak-to-peak voltage values Vpp (A), Vpp(B), and Vpp(C) may be selected by using a peak-to-peak voltage value table 71 set based on combination of accumulated use time, temperature, and humidity. Or, in a case where a charging roller 41 having a volume resistance that does not vary much with environment is used, a peak-to-peak voltage value table 71 set based only on accumulated use time of the charging roller 41 may be used.

It should be understood that the present disclosure is not limited to the above embodiments, and various modifications are possible within the scope of the present disclosure. For example, the above embodiments have dealt with cases where the AC voltage applied by the high-voltage generating circuit 43 to the charging roller 41 has a sinusoidal waveform, but instead, the AC voltage may have a rectangular, triangular, or pulse waveform.

Further, the present disclosure is not limited to monochrome printers as shown in FIG. 1, but is certainly applicable to various types of image forming apparatuses, such as color copiers, color printers, monochrome copiers, digital multifunction peripherals, and facsimile machines.

The present disclosure is usable in an image forming apparatus including a charging member which charges an image carrier. By using the present disclosure, it is possible to provide an image forming apparatus capable of making an appropriate peak-to-peak voltage used in an image forming operation extremely close to a voltage appearing at a time when an inclination of charging voltage changes, and capable of effectively reducing occurrence of increased surface friction coefficient of an image carrier and occurrence of image deletion under a high-temperature, high-humidity environment, which result from an excessive amount of discharge from a charging member.

What is claimed is:

1. An image forming apparatus comprising:

an image carrier which has a surface of which an electrostatic latent image is to be formed;

a charging member which charges the surface of the image carrier;

a high-voltage generating circuit which applies to the charging member oscillation voltage in which a DC voltage and an AC voltage are superimposed;

a voltage controller which controls the DC voltage and a peak-to-peak voltage value Vpp of the AC voltage; and a current detector which detects a DC current value Idc between the charging member and the image carrier, wherein the high-voltage generating circuit applies to the charging member, as the oscillation voltage, an oscillation voltage having a peak-to-peak voltage value Vpp(A), an oscillation voltage having a peak-to-peak voltage value Vpp(B), and an oscillation voltage having a peak-to-peak voltage value Vpp(C), the peak-to-peak voltage value Vpp(A) and the peak-to-peak voltage value Vpp (B) being set to values assumed to be lower than a voltage value at an inflection point at which inclination of the oscillation voltage changes in a characteristic curve on a two-dimensional coordinate system indicating a relationship between the voltage value Vpp and the current value Idc when the peak-to-peak voltage value Vpp is raised, the peak-to-peak voltage value Vpp(C) being set to a value assumed to be higher than the voltage value at the inflection point, the current detector detects DC current values Idc(A), Idc(B), and Idc(C) which respectively appear between the charging member and the image carrier when the oscillation voltage having the peak-to-peak voltage value Vpp(A), the oscillation voltage having the peak-to-peak voltage value Vpp(B), and the oscillation voltage having the peak-to-peak voltage value Vpp(C) are applied to the charging member, the voltage controller calculates a straight line L1 passing through coordinates A(Vpp(A), Idc(A)) and coordinates B(Vpp(B), Idc(B)) on the two-dimensional coordinate system, the voltage controller, by using the peak-to-peak voltage value Vpp at an intersection point of a straight line passing through coordinates C(Vpp(C), Idc(C)) and parallel to the coordinate axis representing the peak-to-peak voltage value Vpp and the straight line L1 as a provisional appropriate peak-to-peak voltage value Vpp(O'), detects a DC current value Idc(O') which appears when an oscillation voltage having the provisional appropriate peak-to-peak voltage value Vpp(O') is applied to the charging member, and the voltage controller determines a peak-to-peak voltage value Vpp(O) at the intersection point O between a straight line L2 passing through the coordinates C(Vpp (C), Idc(C)) and coordinates O'(Vpp(O'), Idc(O)) and the straight line L1 as an appropriate peak-to-peak voltage value.

2. The image forming apparatus of claim 1, further comprising:

a storage which stores therein table data in which, as the peak-to-peak voltage, a plurality of peak-to-peak voltages, including the peak-to-peak voltage value Vpp(A), the peak-to-peak voltage value Vpp(B), and the peak-to-peak voltage value Vpp(C), are stored in association with at least one of temperature in the image forming apparatus, humidity in the image forming apparatus, and an accumulated use time of the charging member, wherein the voltage controller determines, by using at least one of the temperature in the image forming apparatus, the humidity in the image forming apparatus, and the accumulated use time of the charging member and the table data, the peak-to-peak voltage value Vpp(A), the peak-to-peak voltage value Vpp(B), and the peak-to-peak voltage value Vpp(C), and the voltage controller calculates the peak-to-peak voltage value Vpp(O).

3. The image forming apparatus of claim 2, further comprising:

a temperature sensor which detects temperature in the image forming apparatus; and a humidity sensor which detects humidity in the image forming apparatus, wherein by using actually measured values of the temperature and the humidity in the image forming apparatus and the table data, the voltage controller determines the peak-to-peak voltage value Vpp(A), the peak-to-peak voltage value Vpp(B), and the peak-to-peak voltage value Vpp(C), and calculates the peak-to-peak voltage value Vpp(O).

4. The image forming apparatus of claim 3, wherein the voltage controller performs processing of determining the appropriate peak-to-peak voltage value in a non-image formation period during which image forming processing with respect to the image carrier is not performed.

5. The image forming apparatus of claim 2, wherein the voltage controller performs processing of determining the appropriate peak-to-peak voltage value in a non-image formation period during which image forming processing with respect to the image carrier is not performed.

6. The image forming apparatus of claim 1, wherein the voltage controller performs processing of determining the appropriate peak-to-peak voltage value in a non-image formation period during which image forming processing with respect to the image carrier is not performed.

7. The image forming apparatus of claim 1, wherein the image carrier has, on the surface thereof, a photosensitive layer made of amorphous silicon.

* * * * *